US006957126B2

(12) United States Patent
Kim

(10) Patent No.: US 6,957,126 B2
(45) Date of Patent: Oct. 18, 2005

(54) TABLET CASSETTE CONTROL METHOD OF MEDICATION DISPENSING AND PACKAGING SYSTEM

(76) Inventor: Jun Ho Kim, 100-23, Galsandong, Daisuhgu, Taegu (KR)

( * ) Notice: Subject to any disclaimer, the term of this patent is extended or adjusted under 35 U.S.C. 154(b) by 0 days.

(21) Appl. No.: 10/976,106

(22) Filed: Oct. 28, 2004

(65) Prior Publication Data

US 2005/0096787 A1 May 5, 2005

(30) Foreign Application Priority Data

Nov. 5, 2003 (KR) ..... 10-2003-0077945

(51) Int. Cl.[7] ..... G06F 17/00

(52) U.S. Cl. ..... 700/244; 700/213; 221/9; 53/396

(58) Field of Search ..... 700/231, 240, 700/242, 244, 225; 221/2, 9; 53/396

(56) References Cited

U.S. PATENT DOCUMENTS 5,671,592 A * 9/1997 Yuyama et al. ..... 53/493
5,709,063 A * 1/1998 Yuyama et al. ..... 53/154
5,819,500 A * 10/1998 Haraguchi et al. ..... 53/154
2003/0074868 A1 * 4/2003 Yasuoka et al. ..... 53/493

* cited by examiner

*Primary Examiner*—Khoi H. Tran
(74) *Attorney, Agent, or Firm*—Park & Sutton LLP; John K. Park

(57) ABSTRACT

A tablet cassette control method of a medication dispensing and packaging system having a microcomputer, a medication dispensing unit with a plurality of tablet cassettes each mounted on a cassette rack, and a medication packaging unit disposed below the dispensing unit to package tablets released from the dispensing unit into a series of tablet containing paper bags, the control method comprises confirming the mounting of the tablet cassette on the cassette rack, applying a power to a memory in the tablet cassette to activate the memory, retrieving tablet information saved in the memory to the microcomputer, and breaking the power from the memory while maintaining operation of the system.

16 Claims, 7 Drawing Sheets

TABLET CASSETTE CONTROL METHOD OF MEDICATION DISPENSING AND PACKAGING SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of Nov. 5, 2003, with the patent application number 10-2003-0077945, by the applicant. (See the attached Declaration)

BACKGROUND OF THE INVENTION

The invention relates to a medication dispensing and packaging system. More particularly, the present invention relates to a tablet cassette control method of a medication dispensing and packaging system minimizing errors resulting from instability of connection between a memory in a tablet cassette and a microcomputer.

An automatic tablet dispensing and packaging system is generally provided with a tablet packaging unit and a tablet dispensing unit placed above the packaging unit. The table dispensing unit includes tablet cassettes each storing therein and dropping therefrom a predetermined set of tablets. The prior arts disclosed in relation thereto include Japanese Patent Application Nos. 1994-208787, 1994-248055, 1994-256542, 1998-275670, 2001-00089865, 2001-00303159, and 2001-00376104. Each publication thereto discloses a system where a tablet cassette having a memory transmits tablet information of the memory to a controller.

FIG. 8 discloses Korean Utility Model No. 20-0276236 by the present applicant, titled a tablet cassette installation-error prevention system. As shown therein, a memory 101 having tablet information of respective tablet cassette 100 is provided in an adapter 102 installed in a lower surface of the tablet cassette 100. A terminal extending downwardly from the adapter 102 is inserted in a socket 201 formed in an upper surface of the cassette rack 200, and the microcomputer 300 connected to the socket 201 retrieves the tablet information from the memory 101. In this construction, a rotor 104 provided in the tablet cassette 100 and driven by a motor 202 serves to discharge tablets from the tablet cassette 100. Here, the rotor 104 makes a rotation in accordance with drive of the motor 202.

A disadvantage of the prior art is that the rotor's rotation inevitably generates vibration to the tablet cassette, subsequently causing the terminal to sway and resulting in intermittent terminal disconnection. Such terminal disconnection leads to errors in the memory so that the microcomputer does not recognize the cassette or erroneously reads it as empty. Another disadvantage is that frequent disconnection of the terminal from the socket breaks off the power from the memory, causing loss of tablet information.

SUMMARY OF THE INVENTION

The present invention is contrived to overcome the conventional disadvantages. Accordingly, an object of the present invention is to provide a tablet cassette control method of a medication dispensing and packaging system minimizing errors resulting from instability of connection between a memory in a tablet cassette and a microcomputer.

Another object of the present invention is to efficiently sense detachment of the cassette from a cassette rack after electricity is cut off from a memory in the tablet cassette.

A further object is to facilitate cassette installation or detachment on or from the cassette rack without regard to vibration of the tablet cassette caused by the rotor's rotation within the tablet cassette.

To achieve these and other objects, the tablet cassette control method of a medication tablet dispensing and packaging system according to the present invention is provided with a microcomputer, a medication dispensing unit with a plurality of tablet cassettes each mounted on a cassette rack, and a medication packaging unit disposed below the dispensing unit to package tablets released from the dispensing unit into a series of tablet containing paper bags. The control method comprises the steps of confirming the mounting of the tablet cassette on the cassette rack, applying a power to a memory in the tablet cassette to activate the memory, retrieving tablet information saved in the memory to the microcomputer, and breaking the power from the memory while maintaining operation of the system. In an embodiment, the control method further comprises the step of acknowledging the detachment of the tablet cassette from the cassette rack.

For a better performance, the confirming of the mounting of the tablet cassette on the cassette is implemented by a light interception between a light emitter and a light receptor of the cassette rack. The light emitter is an LED under control of the microcomputer to continue turning on/off in a regular frequency. The light interception is implemented by a light interceptor extending from the tablet cassette. The light emitter stays turned on for between about 700 $\mu$s and about 900 $\mu$s, and preferably at 825 $\mu$s of a second and stays turned off for the rest of the second in a regular frequency when resistances of the light emitter and receptor are respectively at about 500Ω and at about 18 kΩ. The memory has a terminal and the cassette rack has a socket, wherein the terminal is inserted in the socket when the tablet cassette is mounted on the cassette rack. The mounting of the tablet cassette on the corresponding cassette rack activates the terminal of the memory to enable the microcomputer to retrieve the tablet information from the memory.

The advantages of the present invention are numerous in that: (1) once the microcomputer retrieves tablet information from the memory in the corresponding tablet cassette at the time of cassette refill or replacement, the electricity shuts off from the memory while maintaining operation of the system, thereby protecting the tablet information in the memory without regard to the inevitable cassette swaying and vibration resulting from the rotor's rotation; (2) the detachment of a tablet cassette from the cassette rack is efficiently, accurately detected by means of a light interruption between the light emitter and the light receptor, thereby improving system reliability and user's satisfaction; and (3) a light interception between the light emitter and the light receptor is implemented in a simplified light control mechanism using a light interceptor extending from the tablet cassette, thereby improving product durability and marketability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
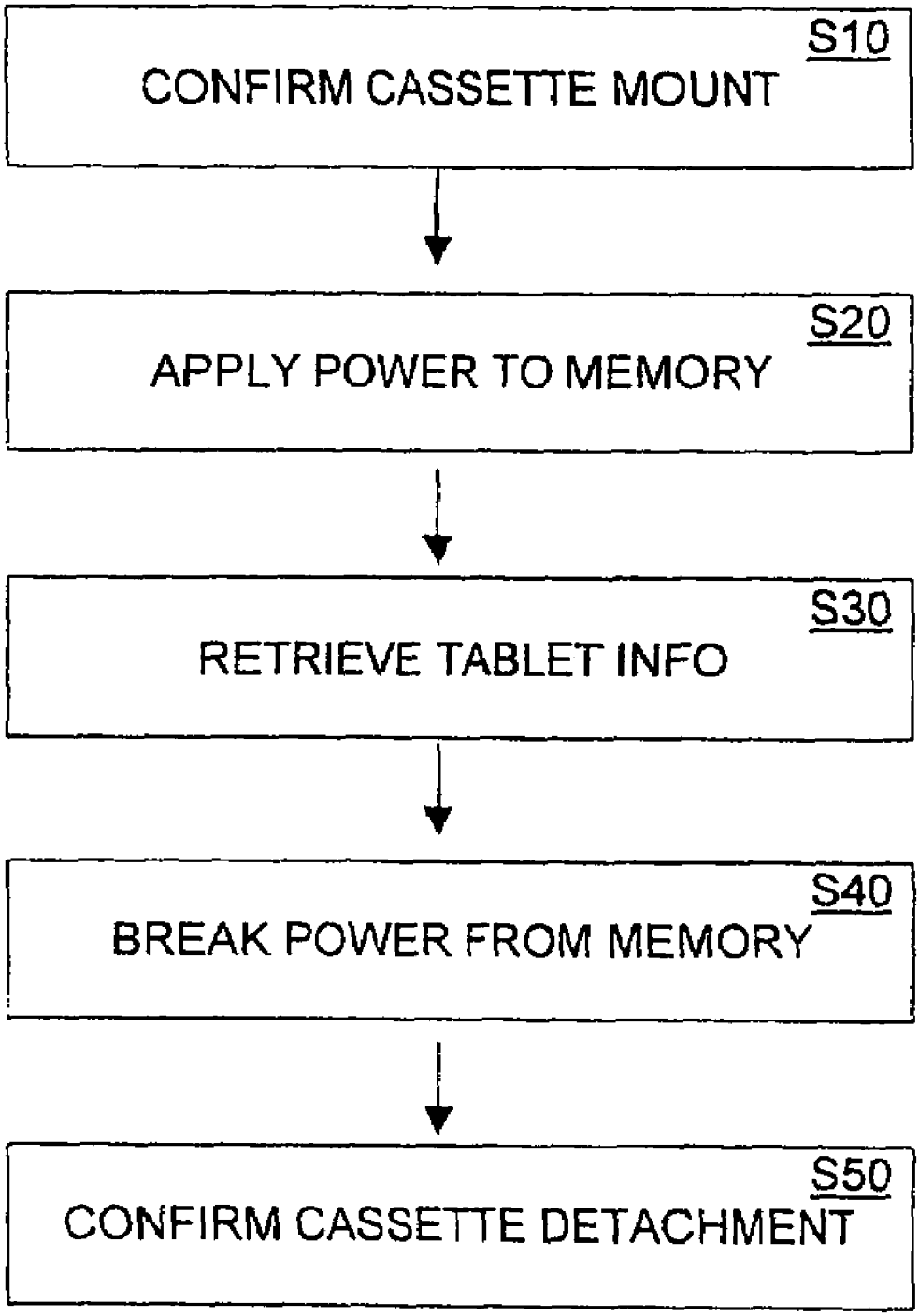
FIGS. 1 and 2 are flow charts showing a tablet cassette control method of a medication dispensing and packaging method according to the present invention.
Figure 2:
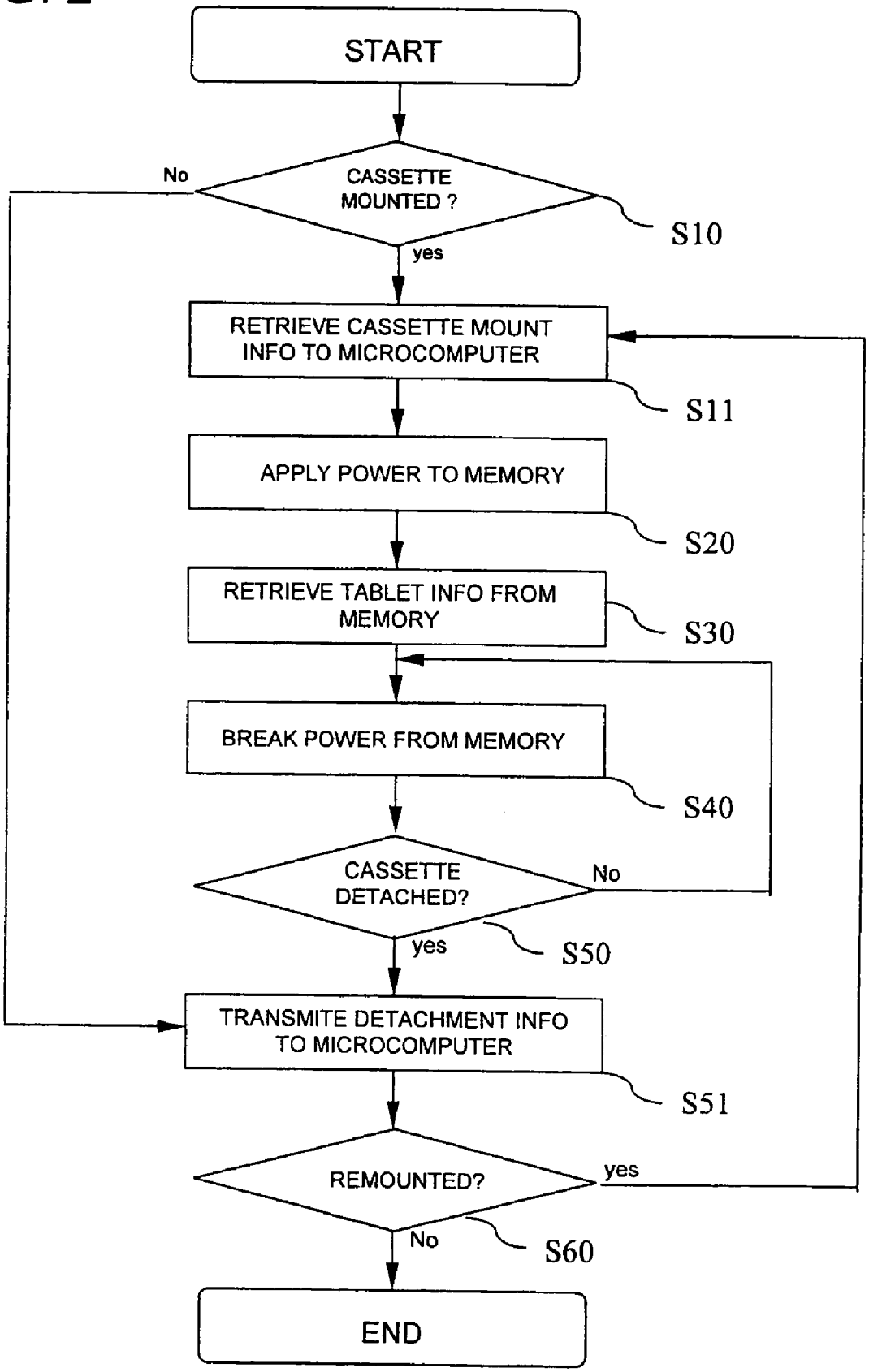
Figure 3:
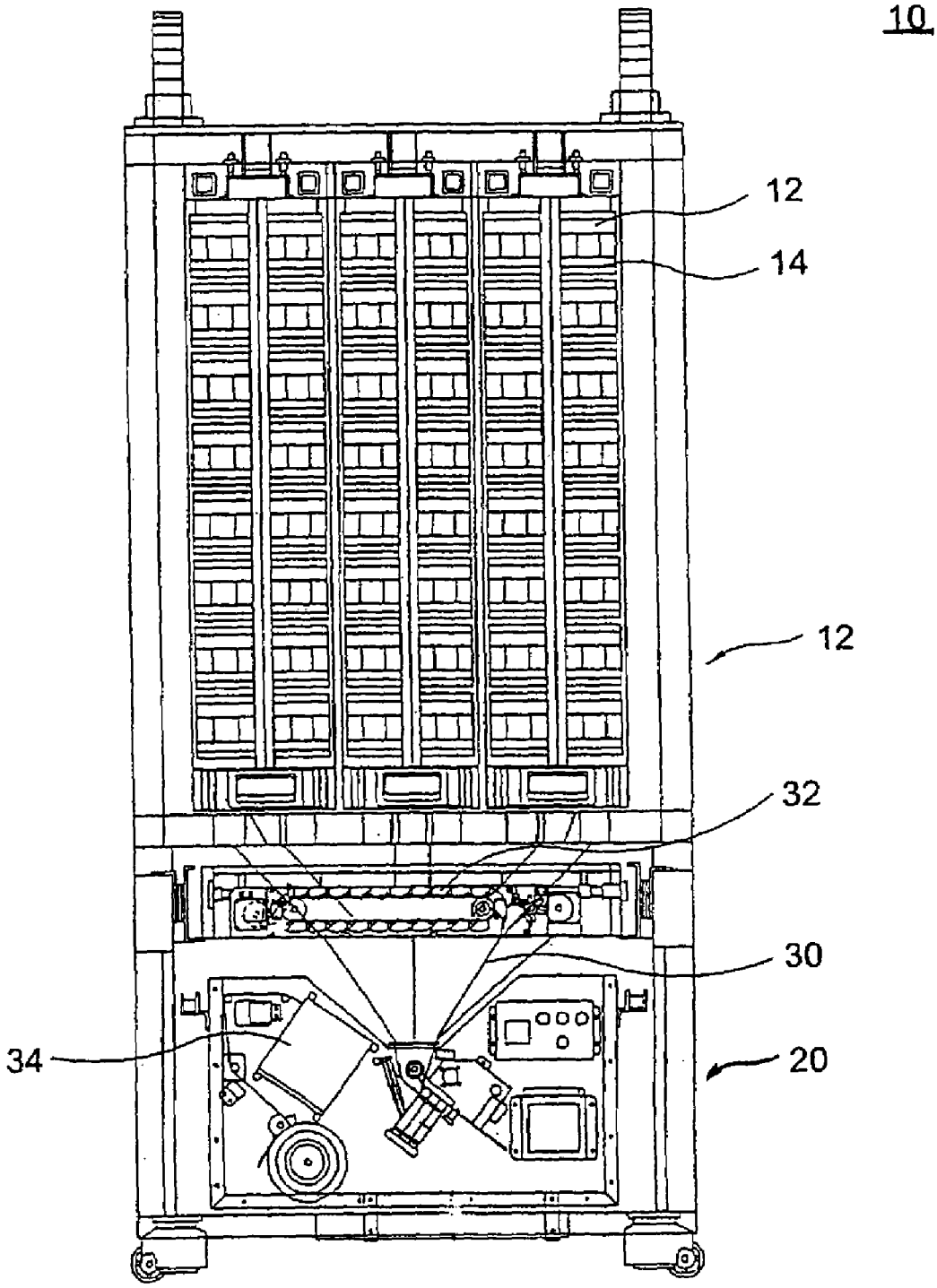
FIG. 3 is a view showing the medication tablet dispensing and packaging system.
Figure 4:
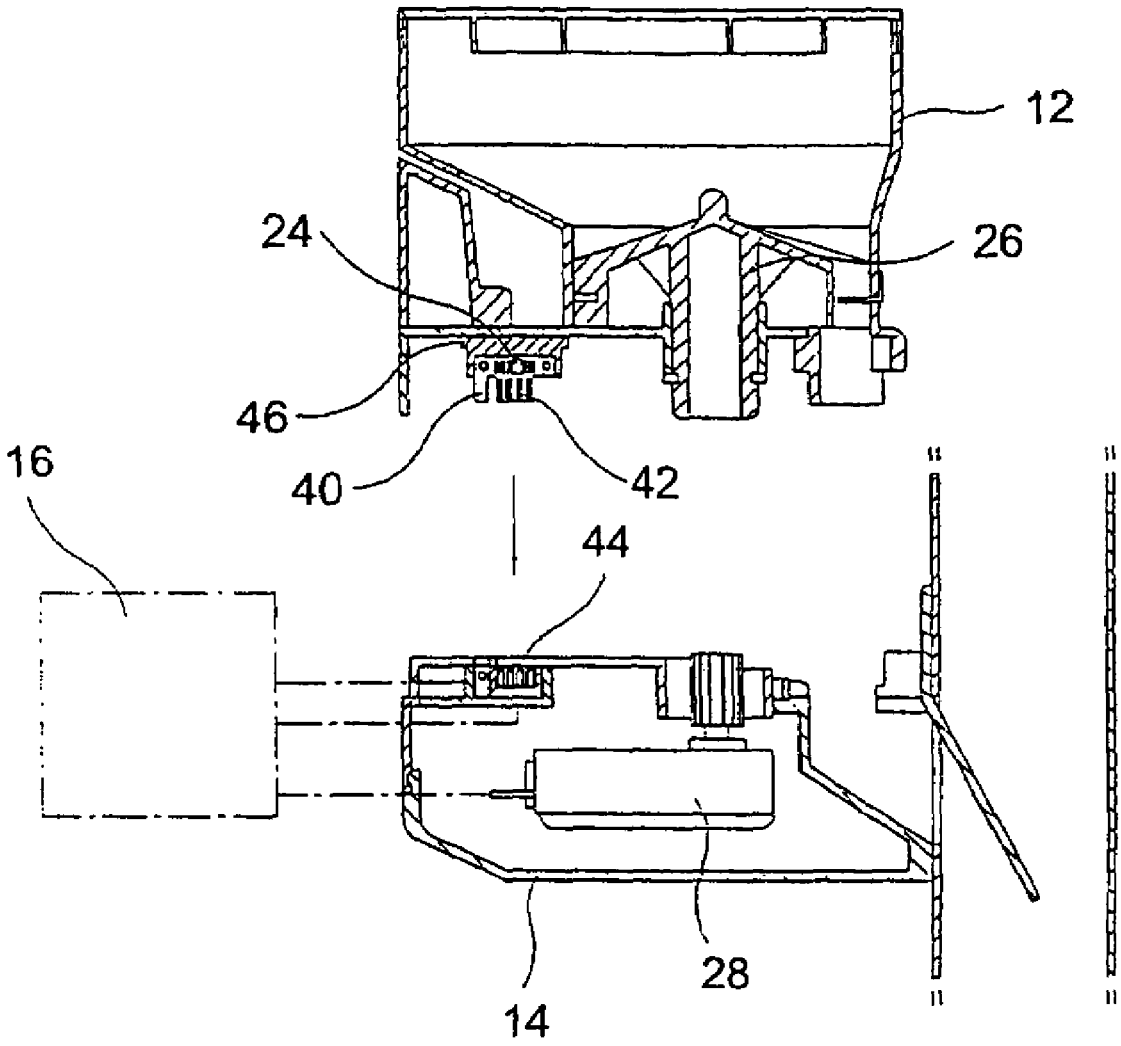
FIG. 4 is a view showing disassembly of a tablet cassette and a cassette rack according to the present invention.
Figure 5:
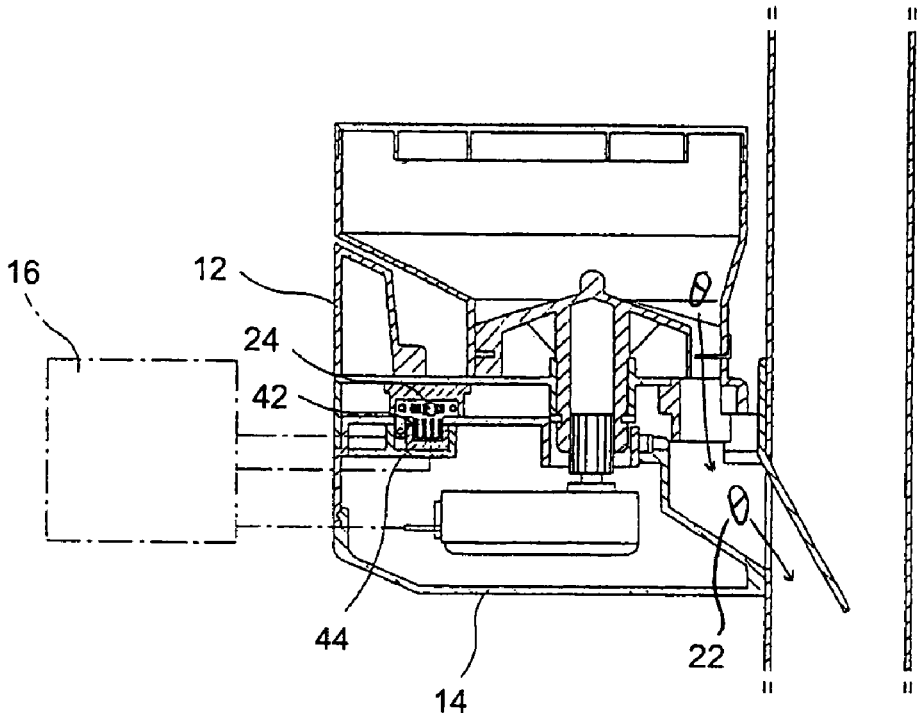
FIG. 5 is a view showing assembly of the tablet cassette and cassette rack in FIG. 4.

FIGS. 1–2 show flowcharts sequentially explaining a tablet cassette control method of a medication dispensing and packaging system 10 illustrated in FIG. 3. FIG. 4 shows detachment of a tablet cassette 12 from a cassette rack 14 whereas FIG. 5 shows mounting of the tablet cassette 12 on the cassette rack 14.

As shown therein, the medication dispensing and packaging system 10 comprises a microcomputer 16, a medication dispensing unit with a plurality of tablet cassettes 12 each mounted on a cassette rack 14, and a medication packaging unit 20 disposed below the dispensing unit 18 to package tablets 22 released from the dispensing unit 18 into a series of tablet containing paper bags (not shown).

The system 10 houses about hundreds of tablet cassettes 12 where the tablets contained in a tablet cassette is different in type and medication purposes from those contained in another tablet cassette. In this construction, each tablet cassette 12 identifies itself via communication with the microcomputer 16. That is, a memory 24 is embedded in each tablet cassette 12 and then it is linked to the microcomputer 16. The link between the memory 24 in the tablet cassette 12 and the microcomputer 16 is implemented through the cassette rack 14. The tablets filled in the tablet cassette 12 is selectively released by rotation of the rotor 26 engaged to the motor 28 in the cassette rack 14. The control method introduced in the system 10 is to eliminate the inevitable cassette swaying and vibration so that the microcomputer 16 retrieves tablet information from the memory 24 in an error-free manner.

As shown back in FIG. 1, the cassette control method of the medication tablet dispensing and packaging system 10 sequentially comprises the steps of confirming the mounting of the tablet cassette 12 on the cassette rack 14 (S10), applying an electric power to the memory 24 in the tablet cassette 12 to activate the memory 24 (S20), retrieving tablet information saved in the memory 24 to the microcomputer 16 (S30), and breaking the power from the memory 24 while maintaining operation of the system 10 (S40). In a preferred embodiment, the control method further comprises, after the power break from the memory 24, the step of acknowledging the detachment of the tablet cassette 12 from the cassette rack 14 (S50). The cassette control method of the medication tablet dispensing and packaging system 10 will now be explained in further detail with reference to FIG. 2.

First, during the system operation, an individual tablet cassette 12 is checked to confirm whether the tablet cassette 12 is mounted on the cassette rack 14 (S10). If the mounting of the tablet cassette 12 on the cassette rack 14 is confirmed, the mounting status information is transmitted to the microcomputer 16 (S11) which then applies an electric power to the memory 24 in the tablet cassette 12 so as to activate the memory 24 (S20). Selectively, if the mounting is not confirmed the detachment information is sent to the microcomputer 16. Subsequently, the tablet information saved in the memory 24 is retrieved to the microcomputer 16 (S30) and the power becomes shut off from the memory 24 while maintaining operation of the system 10 (S40).

Afterwards, the tablet cassette detachment from the cassette rack 14 is checked to confirm the cassette mounting status (S50). If the cassette 12 remains mounted on the cassette rack 14, the power break status is maintained, whereas if the cassette 12 is checked detached from the cassette rack 14, the detachment information is sent to the microcomputer 16 (S51). Meanwhile, if remounting is subsequently confirmed the remounting information is sent back to the microcomputer 16 (S60). The tablets released from the tablet cassettes and from a conveyer tray 32 carrying special medication such as half-split tablets are guided by a hopper 30 down to tablet packaging unit 20 where the tablets are paper-packaged with instruction printed by the printer 34 and sealed to a series of tablet containing paper packages.

Figure 6:
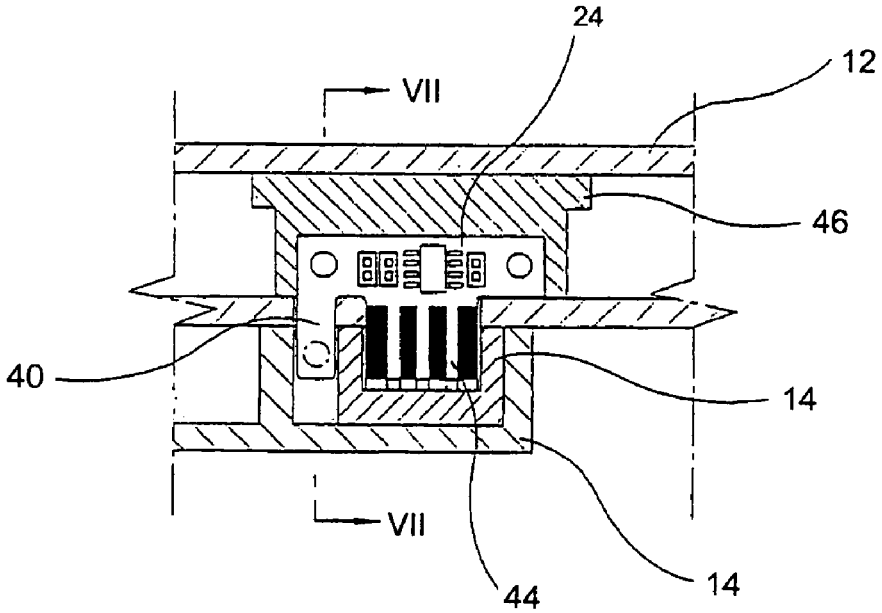
FIG. 6 is an enlargement view detailing attachment of the tablet cassette and cassette rack.
Figure 7:
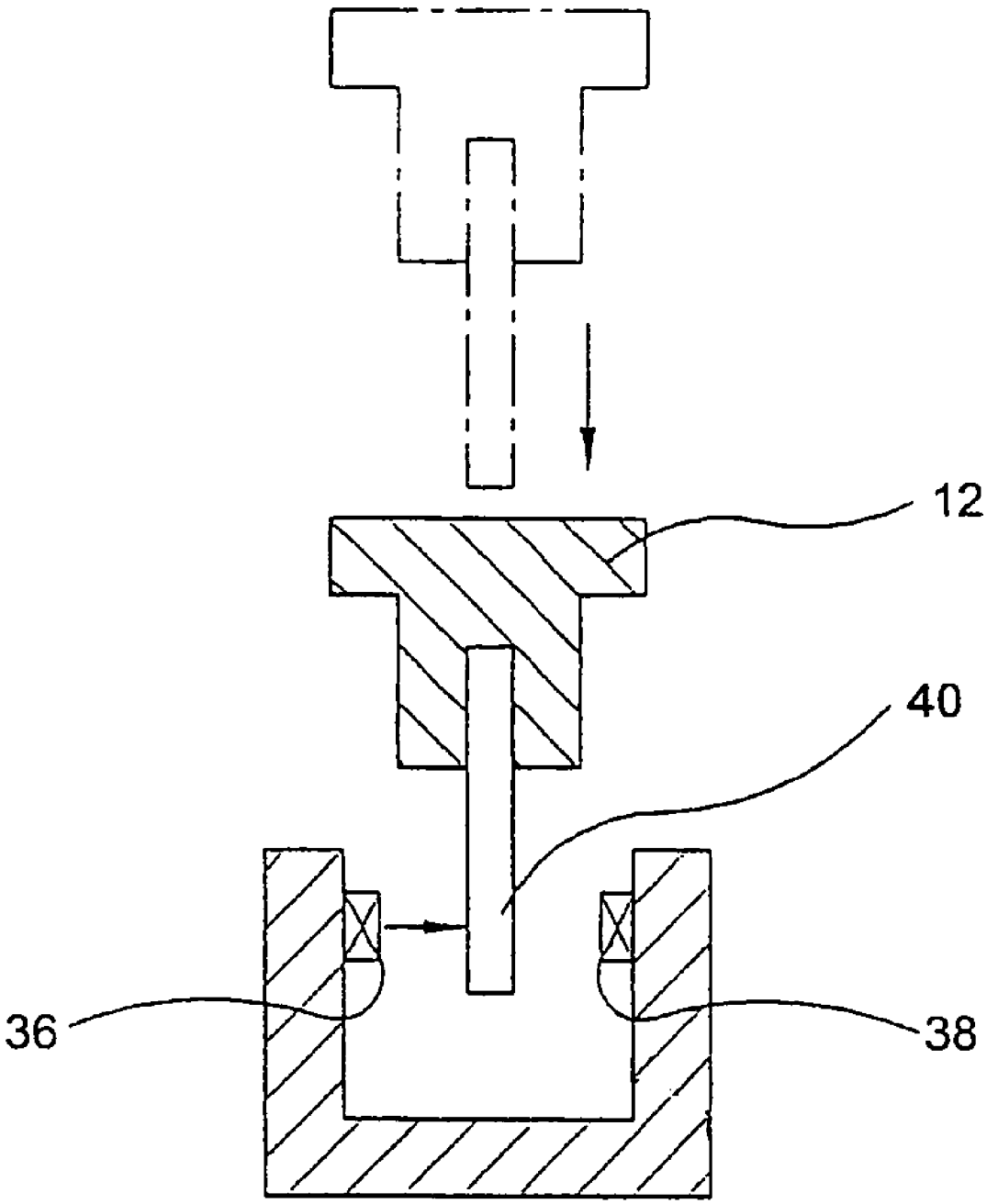
FIG. 7 is a schematic view showing a light interception between a light emitter and a light receptor.
Figure 8:
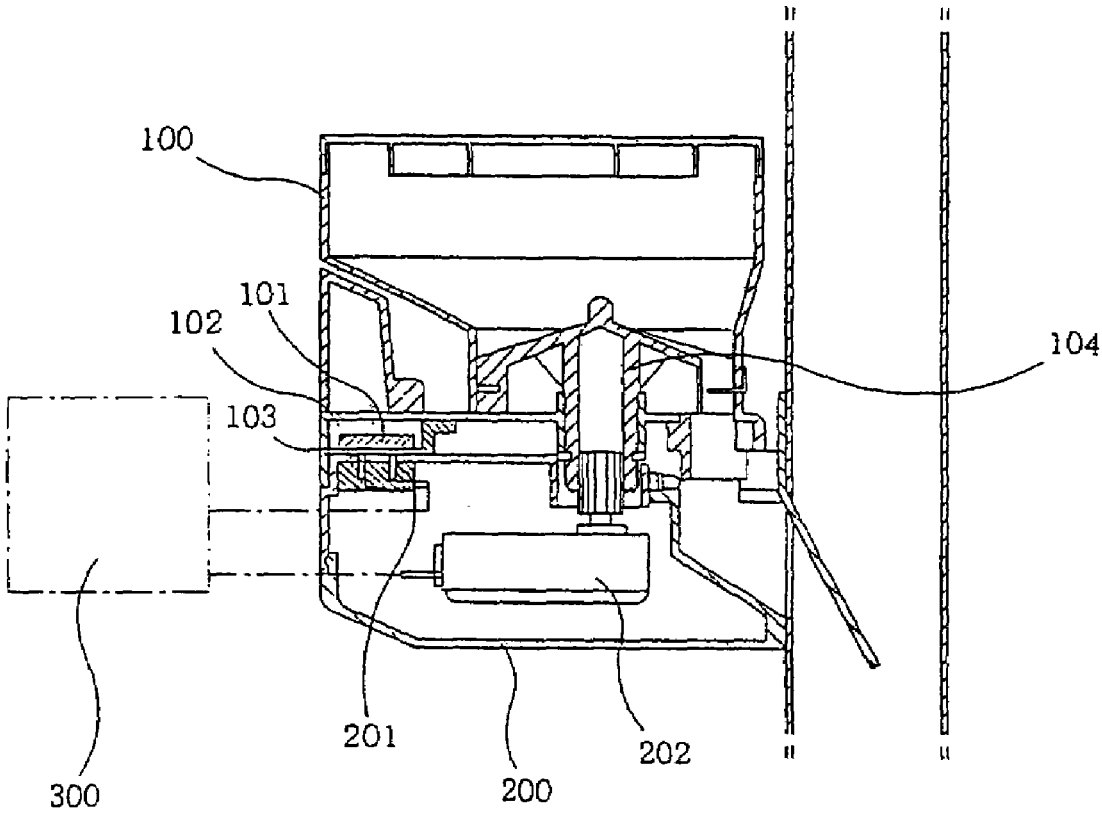
FIG. 8 PRIOR ART
FIG. 8 is a view showing a prior art.

As shown in FIGS. 6 and 7, the confirming of the mounting of the tablet cassette 12 on the cassette rack is implemented by a light interception between a light emitter 36 and a light receptor 38 of the cassette rack 14. The light emitter 36 is an LED under control of the microcomputer 16 to continue turning on/off in a regular frequency. Preferably, the light interception is implemented by a light interceptor 40 extending from the tablet cassette 12.

For a better performance, the light emitter 36 stays turned on for between about 700 $\mu$s and about 900 $\mu$s of a second and stays turned off for the rest of the second in a regular frequency when resistances of the light emitter 36 and receptor 38 are respectively at about 500Ω and at about 18 kΩ. Preferably, the light emitter 36 stays turned on for 825 $\mu$s of a second and stays turned off for the rest of the second in a regular frequency when resistances of the light emitter and receptor are respectively at 500Ω and at 18 kΩ. Specifically, a photo interrupt (not shown) in the microcomputer 16 is put on-duty 40 (4:6=on:off) for 260 $\mu$s in every 126 $\mu$s interval which denotes duration of power cutoff by the light emitter 36 when checking attachment of the tablet cassette 12 on the cassette rack 14.

To streamline the connection mechanism between the tablet cassette 12 and cassette rack 14, the memory 24 has a terminal 42 and the cassette rack 14 has a socket 44 so that the terminal 42 is inserted in the socket 44 when the tablet cassette 12 is mounted on the cassette rack 14. Here, an adapter 46 is formed in the tablet cassette 12 to carry the memory 24 from which the terminal 42 extends. The mounting of the tablet cassette on the corresponding cassette rack 14 activates the terminal 42 of the memory 24 to enable the microcomputer 16 to retrieve the tablet information from the memory 24.

As discussed above, an advantage of the control method according to the present invention is that once the microcomputer 16 retrieves tablet information from the memory 24 in the corresponding tablet cassette 12 at the time of cassette refill or replacement, the electricity shuts off from the memory 24 while maintaining operation of the system 10, thereby protecting the tablet information in the memory without regard to the inevitable cassette swaying and vibration resulting from the rotor's rotation.

In addition, the detachment of a tablet cassette from the cassette rack is efficiently, accurately detected by means of a light interruption between the light emitter 36 and the light receptor 38, thereby improving system reliability and user's satisfaction. Further, a light interception between the light emitter 36 and the light receptor 38 is implemented in a simplified light control mechanism using a light interceptor 40 extending from the tablet cassette 12, thereby improving product durability and marketability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A tablet cassette control method of a medication dispensing and packaging system having a microcomputer, a medication dispensing unit with a plurality of tablet cassettes each mounted on a cassette rack, and a medication packaging unit disposed below the dispensing unit to package tablets released from the dispensing unit into a series of tablet containing paper bags, the control method comprising the steps of:

a) confirming the mounting of the tablet cassette on the cassette rack;

b) applying a power to a memory in the tablet cassette to activate the memory;

c) retrieving tablet information saved in the memory to the microcomputer; and d) breaking the power from the memory while maintaining operation of the system.

2. The control method of claim 1 wherein the confirming of the mounting of the tablet cassette on the cassette rack is implemented by a light interception between a light emitter and a light receptor of the cassette rack.

3. The control method of claim 2 wherein the light emitter is an LED under control of the microcomputer to continue turning on/off in a regular frequency.

4. The control method of claim 2 wherein the light interception is implemented by a light interceptor extending from the tablet cassette.

5. The control method of claim 3 wherein the light emitter stays turned on for between about 700 $\mu$s and about 900 $\mu$s of a second and stays turned off for the rest of the second in a regular frequency when resistances of the light emitter and receptor are respectively at about 500Ω and at about 18 kΩ.

6. The control method of claim 3 wherein the light emitter stays turned on for 825 $\mu$s of a second and stays turned off for the rest of the second in a regular frequency when resistances of the light emitter and receptor are respectively at 500Ω and at 18 kΩ.

7. The control method of claim 1 wherein the memory has a terminal and the cassette rack has a socket, wherein the terminal is inserted in the socket when the tablet cassette is mounted on the cassette rack.

8. The control method of claim 7 wherein the mounting of the tablet cassette on the corresponding cassette rack activates the terminal of the memory to enable the microcomputer to retrieve the tablet information from the memory.

9. A tablet cassette control method of a medication dispensing and packaging system having a microcomputer, a medication dispensing unit with a plurality of tablet cassettes each mounted on a cassette rack, and a medication packaging unit disposed below the dispensing unit to package tablets released from the dispensing unit into a series of tablet containing paper bags, the control method comprising the steps of:

a) confirming the mounting of the tablet cassette on the cassette rack;

b) applying a power to a memory in the tablet cassette to activate the memory;

c) retrieving tablet information saved in the memory to the microcomputer;

d) breaking the power from the memory while maintaining operation of the system; and e) acknowledging the detachment of the tablet cassette from the cassette rack.

10. The control method of claim 9 wherein the confirming of the mounting of the tablet cassette on the cassette rack is implemented by a light interception between a light emitter and a light receptor of the cassette rack.

11. The control method of claim 10 wherein the light emitter is an LED under control of the microcomputer to continue turning on/off in a regular frequency.

12. The control method of claim 11 wherein the light interception is implemented by a light interceptor extending from the tablet cassette.

13. The control method of claim 11 wherein the light emitter stays turned on for between about 700 $\mu$s and about 900 $\mu$s of a second and stays turned off for the rest of the second in a regular frequency when resistances of the light emitter and receptor are respectively at about 500Ω and at about 18 kΩ.

14. The control method of claim 11 wherein the light emitter stays turned on for 825 $\mu$s of a second and stays turned off for the rest of the second in a regular frequency when resistances of the light emitter and receptor are respectively at 500Ω and at 18 kΩ.

15. The control method of claim 9 wherein the memory has a terminal and the cassette rack has a socket, wherein the terminal is inserted in the socket when the tablet cassette is mounted on the cassette rack.

16. The control method of claim 15 wherein the mounting of the tablet cassette on the corresponding cassette rack activates the terminal of the memory to enable the microcomputer to retrieve the tablet information from the memory.

* * * * *